US009499962B2

(12) United States Patent
Joseph

(10) Patent No.: US 9,499,962 B2
(45) Date of Patent: Nov. 22, 2016

(54) POP-UP DRAIN VALVE STOPPER WITH STRAINER CUP

(71) Applicant: Douglas S Joseph, Moreland Hills, OH (US)

(72) Inventor: Douglas S Joseph, Moreland Hills, OH (US)

( * ) Notice: Subject to any disclaimer, the term of this patent is extended or adjusted under 35 U.S.C. 154(b) by 69 days.

(21) Appl. No.: 14/120,040

(22) Filed: Apr. 17, 2014

(65) Prior Publication Data

US 2014/0310862 A1 Oct. 23, 2014

Related U.S. Application Data

(60) Provisional application No. 61/854,400, filed on Apr. 23, 2013.

(51) Int. Cl.
*E03C 1/262* (2006.01)
*E03C 1/23* (2006.01)

(52) U.S. Cl.
CPC ..... *E03C 1/262* (2013.01); *E03C 1/2302* (2013.01)

(58) Field of Classification Search
CPC ..... E03C 1/262; A47K 1/14
USPC ..... 4/287, 292, 652, 286, 288–291, 4/293–295
See application file for complete search history.

(56) References Cited

U.S. PATENT DOCUMENTS 1,494,882 A * 5/1924 Barger ..... E03C 1/264 4/292
1,770,639 A * 7/1930 Sanders ..... E03C 1/23 4/286
1,811,170 A * 6/1931 Brotz ..... E03C 1/262 285/206
4,380,834 A * 4/1983 Wentz ..... E03C 1/23 4/286
4,381,569 A * 5/1983 Ingram ..... A47K 1/14 138/89
4,932,082 A * 6/1990 Ridgeway ..... E03C 1/23 4/287
7,941,878 B1 * 5/2011 Truong ..... E03C 1/122 4/685
8,011,030 B2 * 9/2011 Li ..... E03C 1/262 4/286
8,590,065 B2 * 11/2013 Ali ..... A47K 1/14 4/287
2004/0255378 A1 * 12/2004 Tracy ..... E03C 1/23 4/689
2010/0000011 A1 * 1/2010 Angarita ..... E03C 1/262 4/287
2011/0126347 A1 * 6/2011 Qian ..... E03C 1/2302 4/287

* cited by examiner

*Primary Examiner* — Erin Deery
(74) *Attorney, Agent, or Firm* — David A. Burge

(57) ABSTRACT

A pop-up drain valve stopper has a lower portion that is retained in a drain pipe through which liquid passes while exiting the bowl of a sink, and an upper portion that is easily disconnected from the lower portion and withdrawn from the drain pipe so a strainer cup carried by the upper portion can be cleaned or replaced as needed. In one embodiment, the strainer cup is an integral part of the upper portion. In another embodiment, the strainer cup can be detached and cleaned or replaced when it has caught a volume of hair and foreign matter. A threaded connection or equivalent may be used to releasably couple the lower and upper portions. A twist connection or equivalent may be used to releasably couple the strainer cup to another part of the upper portion.

16 Claims, 8 Drawing Sheets

POP-UP DRAIN VALVE STOPPER WITH STRAINER CUP

REFERENCE TO PROVISIONAL APPLICATION

This utility application claims the benefit of the Apr. 23, 2013 filing date of provisional application Ser. No. 61/854,400 entitled POP-UP DRAIN VALVE STOPPER WITH STRAINER, the disclosure of which is incorporated herein by reference.

BRIEF SUMMARY OF THE INVENTION

The present invention relates to a pop-up drain valve stopper or plug that extends into a drain pipe which depends from the bowl of a sink such as a bathroom sink or the like. The pop-up drain valve stopper of plug of the present invention is an elongate structure having a strainer cup associated therewith for collecting hair and other foreign matter without interfering with normal operation of the drain valve stopper or plug.

More particularly, the improved, elongate stopper or plug of the present invention has an upper portion or half that includes a strainer cup, with all or part of the upper portion being easily detached from, and easily reattached to a lower portion or half to facilitate cleaning or replacement of the strainer cup. Moreover, in accordance with a further feature of the invention, the lower portion or half is retained within an associated drain pipe that depends from the bowl of the associated sink when the upper portion or half of the stopper or plug is disconnected from the lower portion or half to permit removal for cleaning or possible replacement of the strainer cup prior to reinsertion of the upper portion or half and reconnection of the upper portion or half to the lower portion or half, as will be explained.

BACKGROUND OF THE INVENTION

Modern bathroom lavatories or sinks commonly employ a standard form of elongate pop-up stopper or plug that depends into a drain pipe, and that is extensible upwardly therefrom through a drain opening located at the bottom of a bowl of the lavatory or sink. The elongate pop-up stopper or plug has a cap or top structure at its upper end region that, when elevated above the associated drain opening, opens the drain opening to let liquid from the bowl (referred to herein as "drain liquid") discharge through the drain opening. When lowered to extend substantially flush with the drain opening, the cap or top structure of the pop-up stopper or plug closes and seals the drain opening, thereby retaining drain liquid in the bowl of the associated lavoratory or sink.

More specifically, a typical conventional prior art form of elongate pop-up stopper or plug that is currently being widely sold at hardware, home supply stores and the like is shown in FIG. 1 and is indicated generally by the numeral 50. The elongate stopper or plug 50 is often a one piece device, but may take the form of a pressed-together or bonded-together assembly of individual components that ordinarily does not disassemble.

Referring to FIG. 2, a conventional prior art form of drain valve assembly 40 is shown that is presently widely used with bathroom lavoratories and sinks. The drain valve assembly 40 has relatively movable parts including an elongate pop-up stopper or plug 50 typically of the type shown in FIG. 1. The conventional prior art stopper or plug 50 has a cap or top structure portion 45 at its upper end region that extends above a drain opening 80 of an associated depending drain pipe 75 when the cap or top structure portion 45 of the stopper or plug 50 is raised to an elevated position above the drain opening 80, as is shown in FIG. 2. The cap or top structure portion 45 closes and seals the drain opening 80 of the associated drain valve assembly 40 when the stopper or plug 50 is lowered to extend substantially flush with the drain opening 80.

As can be seen in FIGS. 1 and 2, the conventional stopper or plug 50 commonly has four identical, elongate, perpendicularly radiating ribs or fins 55 that extend substantially vertically to strengthen and/or to reinforce a central region 56 of the stopper or plug 50, and has a lower end region 57 which includes a formation 60 that defines an operating opening 65. As can also be seen in FIG. 2, the drain valve assembly 40 ordinarily includes a conventional, generally horizontally extending, rod-like operating lever 70 that extends into the interior of the drain pipe 75 through a conventional ball-type pivotal connection assembly 90 that joins with the drain pipe 75 at about the same level below the drain opening 80 as where the lower end formation 60 of the stopper or plug 50 resides within the interior of the drain pipe 75.

In a conventional manner well known to those skilled in the art (and which is illustrated in drawings of U.S. Pat. No. 4,380,834 to Wentz, and in published U.S. Application No. 2004/0255378 to Tracy, the disclosures of all of which are incorporated herein by reference), the generally horizontally extending, rod-like operating lever 70 typically has an inner or front end region 71 located within the drain pipe 75, and an outer or rear end region 72 located outside and to the rear of the drain pipe 75. The inner end region 71 extends through the operating opening 65 of the stopper or plug 50 to establish a driving connection between the rod-like operating lever 70 and the stopper or plug 50. The outer end region 72 is connected in a conventional manner with a generally vertically extending operating rod (as is shown in drawings of U.S. Pat. Nos. 8,327,474, 7,941,878 and 6,023,795, the disclosures of all of which are incorporated herein by reference).

When the outer or rear end region 72 of the rod-like operating lever 70 is depressed, the inner or front end region 71 of the rod-like operating lever 70 is raised or moved upwardly, thereby causing the stopper or plug 50 to be raised so the cap or top structure 45 of the stopper or plug 50 is elevated above the drain opening 80 to thereby permit drain liquid from the bowl of an associated conventional bathroom lavatory or sink (not shown) to discharge into the drain pipe 75. When the outer or rear end region 72 of the rod-like operating lever 70 is raised, the inner or front end region 71 moves downwardly, driving the stopper or plug 50 downwardly, and causing the cap or top structure 45 to extend substantially flush with the drain opening 80, thereby closing and sealing the drain opening 80.

Periodic removal or withdrawal of the conventional stopper or plug 50 from the drain pipe 75 (so the stopper or plug 50 can be cleaned of collected hair strands and other foreign matter, or so the stopper or plug 50 can be replaced, if broken) is normally prevented or rendered difficult because the inner or front end region 71 of the rod-like operating lever 70 extends through the operating opening 65 that is defined by the lower end region formation 60 of the elongate stopper or plug 50. The extension of the inner end region 71 of the rod-like operating lever 70 through the operating opening 65 of the stopper or plug 50 retains the stopper or plug 50 within the drain pipe 75, and thereby prevents the stopper or plug 50 from being raised or lifted out of the drain pipe 75. Sometimes an unknowledgeable consumer will cause breakage of the lower end formation 60 of the lower end region 57 of the stopper or plug 50 when he or she attempts to forcefully withdraw the conventional stopper or plug 50 from the associated drain pipe 75.

To properly effect withdrawal of the conventional stopper or plug 50 from an associated drain pipe 75 for cleaning or replacement, it is normally necessary to disassemble the pivotal connection assembly 90 that couples the rodlike operating lever 70 to the drain pipe 75. Disassembly of the pivotal connection assembly 90 is accomplished by unthreading a normally externally knurled retaining cap 91 of the assembly 90, which permits a ball 92 affixed to the rod-like operating lever 70 to be pulled rearwardly out of a housing 93 of the connection assembly 90. Withdrawal of the rod-like operating lever 70 from the housing 93 (which occurs as the ball 92 is pulled out of the housing 93) causes the front or inner end region 71 of the rod-like operating lever 70 to move out of the operating opening 65 at the lower end region 57 of the stopper or plug 50, which frees the stopper or plug 50 to be lifted out of the drain pipe 75 for cleaning or replacement, as may be needed.

To properly reinstall a clean stopper or plug 50 (or to install a replacement stopper or plug 50) in the drain pipe 75, the stopper or plug 50 must be lowered into an operating position within the drain pipe 75. However, in positioning a stopper or plug 50 in the drain pipe 75, care must be taken to orient the stopper or plug 50 so its lower end formation 60 of the lower end region 57 is positioned in the manner shown in FIG. 2, with the opening 65 oriented to receive the inner or front end region 71 of the rod-like operating lever 70. The inner or front end region 71 is then fished, threaded or inserted through the opening 65, and the threaded, externally knurled cap 91 is thereafter reinstalled and tightened gently in place on the housing 93 to establish a leak-free reinstallation of the pivotal connection assembly 90.

As is well known to those skilled in the art, a variety of proposals have been made during recent years to provide drain valve stoppers or plugs with on-board strainers of various types for collecting strands of hair and bits of other foreign matter strained from drain liquid discharged into a drain pipe of a bathroom lavatory or sink, while hopefully permitting drain liquid to discharge in a relatively normal way down the drain pipe. Patents that disclose such proposals include U.S. Pat. No. 4,932,082 to Ridgeway, as well as the Wentz and Tracy references identified above. The disclosures of all three of these documents are incorporated herein by reference.

A problem with the stopper or plug disclosed in the Ridgeway patent is that it does not have an operating opening (such as the operating opening 65) near its lower end region through which a rod-like operating lever (such as the rod-like lever 70) extends to positively drive the stopper or plug (such as the stopper or plug 50) upwardly and downwardly. Although simply resting a stopper or plug atop an operating lever (in accordance with the proposal of Ridgeway) enables an operating lever to positively drive the stopper or plug in an upward direction, the lack of a proper driving connection between the operating lever and the stopper or plug of Ridgeway does nothing to enable the rod-like operating lever to force the stopper or plug downwardly to cause the cap of the stopper or plug to drop into and seal the associated drain opening—hence the arrangement of the Ridgeway proposal often fails to function properly.

A problem with the stoppers or plugs of the type proposed in the Wentz and Tracy references is that such driving connections as are provided by operating levers extending through operating openings at the lower end regions of the stoppers or plugs prevent the stoppers or plugs from being lifted fully out of the associated drain pipes (as has been described) when the stoppers or plugs need to be withdrawn from the associated drain pipes for cleaning. Indeed, a problem encountered with a vast majority of strainer-carrying stopper or plug proposals is that the stoppers or plugs cannot be raised and lifted fully out of the associated drain pipes without first disassembling the conventional ball-type pivotal connection assemblies that establish pivotal couplings where the rod-like operating levers enter the associated drain pipes.

A problem with most proposed drain valve stoppers or plugs that include strainers is that the strainers tend to fill with hair or foreign matter, and tend to clog rather quickly, which means that the drain valve stoppers or plugs need to be lifted out of the associated drain pipes for cleaning at more frequent intervals than is required if stoppers and plugs incorporate no strainers. What this means is that, with most stoppers or plugs that carry strainers, the ball-type pivot assemblies need to be disassembled more frequently than is the case if the stoppers or plugs carried no strainers.

Regardless of whether an elongate drain valve stopper or plug is provided with a strainer, the process of removing the stopper or plug by first disassembling and removing the associated ball-type pivotal connection assembly (such as the ball-type assembly 90) from the associated drain pipe has been awkward, messy and time consuming. Furthermore, the process is rendered even more awkward and time-consuming when the operating lever needs to be fished back through the operating opening located at the lower end region of the stopper or plug after the stopper or plug (and any associated strainer) has been cleaned.

In view of the explanation presented above, the reader will understand that a long-standing need has existed for an improved drain valve stopper or plug having a strainer associated therewith that can be quickly and easily lifted out of an associated drain pipe for cleaning without any need for a time-consuming, awkward and messy disassembly of the associated ball-type pivotal connection of an operating lever to the drain pipe, and without any need to thread the operating lever back through an operating opening of the stopper or plug during reassembly of the ball-type pivotal connection.

SUMMARY OF THE INVENTION

The present invention addresses the foregoing and other needs and problems of the prior art.

In a preferred practice of the present invention, a stopper or plug is provided that can be directly substituted for a conventional stopper or plug of the general type shown in FIGS. 1 and 2—a stopper or plug that utilizes a two-part or plural-part construction which enables an upper portion or half of the stopper or plug to be disconnected and lifted out of a drain pipe so a strainer cup part of the upper portion or half can be cleaned (or in some embodiments replaced—as will be explained) while a lower portion or half of the stopper or plug is retained in and remains in place within the associated drain pipe.

In a preferred practice of the present invention, an improved elongate drain valve stopper or plug is provided that has a strainer cup associated with an upper portion or half that can be easily lifted out of an associated drain pipe of a conventional bathroom lavatory or sink for cleaning, or for replacement of at least the strainer cup of the upper portion or half of the stopper or plug, without any need to disturb, disassemble, remove, reposition or reassemble either the operating lever of a drain valve assembly of a bathroom lavatory or sink, or the lower portion or half of the stopper or plug.

In a preferred practice of the present invention, a much improved elongate stopper or plug is provided that can not only be directly substituted for a conventional stopper or plug, but also features a two-part or plural-part construction that enables a lower portion or half of the stopper or plug to be drivingly connected to a conventional rod-like operating lever, and that enables an upper portion or half of the stopper or plug to be quickly and easily disconnected from the lower portion or half without any need for tools—so the upper portion or half of the stopper or plug can be quickly and easily lifted out of an associated drain pipe whenever cleaning (or even replacement) of its strainer cup is appropriate, and can be quickly and easily reinserted (with a cleaned or with a replacement strainer cup) into the drain pipe and reconnected to the lower portion or half of the stopper or plug which has remained drivingly connected to the associated, generally horizontally extending rod-like operating lever.

In accordance with preferred practice, an elongate drain valve stopper or plug is provided that has an upper portion or half that is easily detached from and reattached to a lower portion or half to facilitate cleaning of a strainer cup that forms a component of the upper portion or half, while the lower portion or half is retained within the associated drain pipe where it continues to be drivingly connected to an associated operating lever of a conventional drain valve assembly—an arrangement that eliminates any need for removal of the operating lever from, or reinsertion of the operating lever into, an operating opening defined near a bottom end region of the lower portion or half of the elongate drain valve stopper or plug.

In some embodiments of the invention, an elongate stopper or plug is not only provided with easily disconnected and easily reconnected upper and lower portions or halves, but also is provided with a strainer cup that forms a detachable component of the upper portion or half—an arrangement that permits the strainer cup to be quickly and easily removed for cleaning or replacement while the upper portion or half is disconnected from the lower portion or half of the stopper or plug.

In some embodiments of the invention, an easily operated connection of a threaded type is provided between a lower portion or half and an upper portion or half of an elongate stopper or plug; and, in preferred practice, relatively coarse threads of the so-called Acme type (such as are commonly used on faucet stems to provide an easy-to-disconnect and easy-to-reconnect threaded coupling) are employed between the lower and upper portions or halves, so that only minimal relative rotation of the lower and upper portions or halves is needed to disconnect and subsequently reconnect the lower and upper portions or halves.

BRIEF DESCRIPTION OF THE DRAWINGS

These and other features and advantages of the present invention will become apparent and are disclosed in greater detail in the description, claims and drawings that follow, wherein the drawings include the following views:

DETAILED DESCRIPTION

Figure 1:
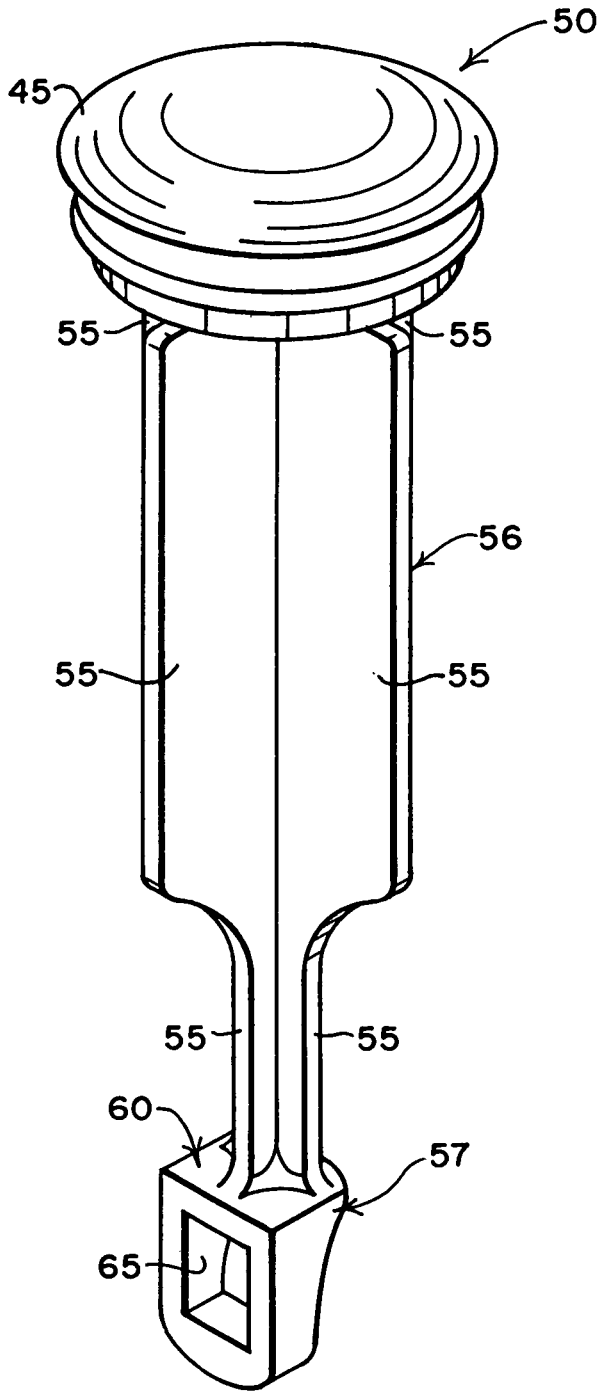
FIG. 1 PRIOR ART
FIG. 1 is a perspective view showing a conventional PRIOR ART pop-up drain valve stopper or plug such as can be found on sale in present day hardware and home improvement stores.
Figure 2:
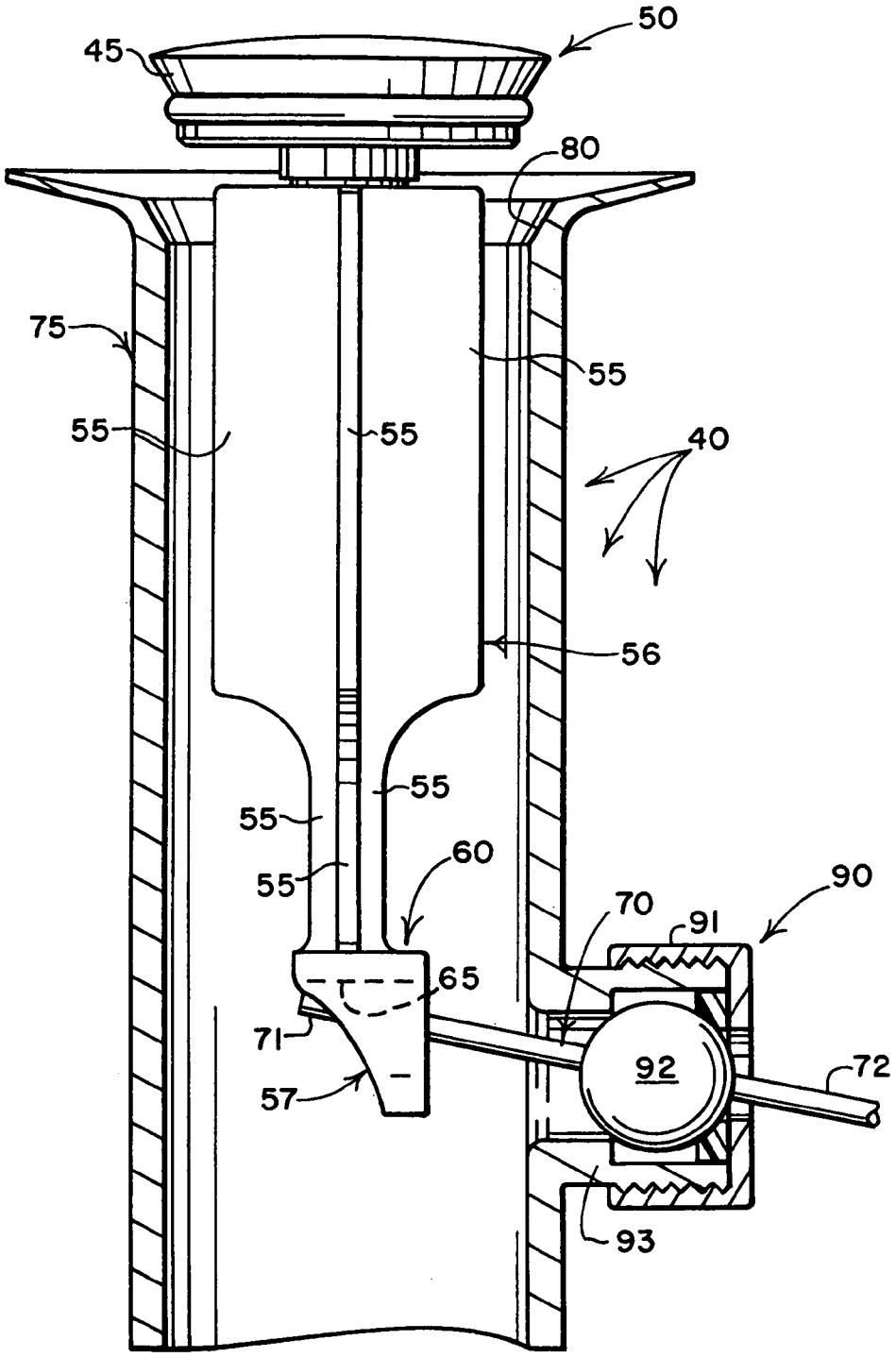
FIG. 2 PRIOR ART
FIG. 2 is a front elevational view, partially in cross-section, showing a conventional PRIOR ART drain valve assembly including a conventional pop-up drain valve stopper or plug of the type shown in FIG. 1.
Figure 3:
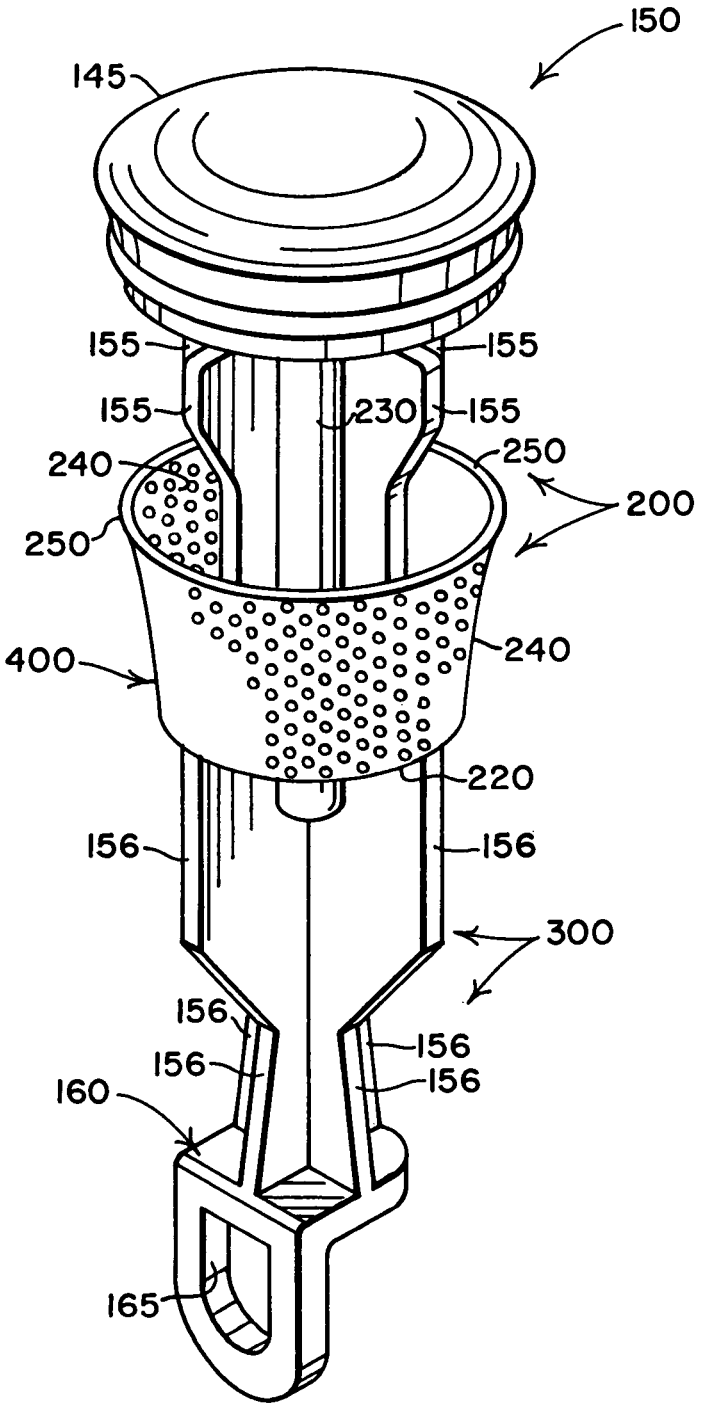
FIG. 3 is a perspective view showing one embodiment of an improved pop-up drain valve stopper or plug with a strainer that embodies selected features of the present invention.
Figure 4:
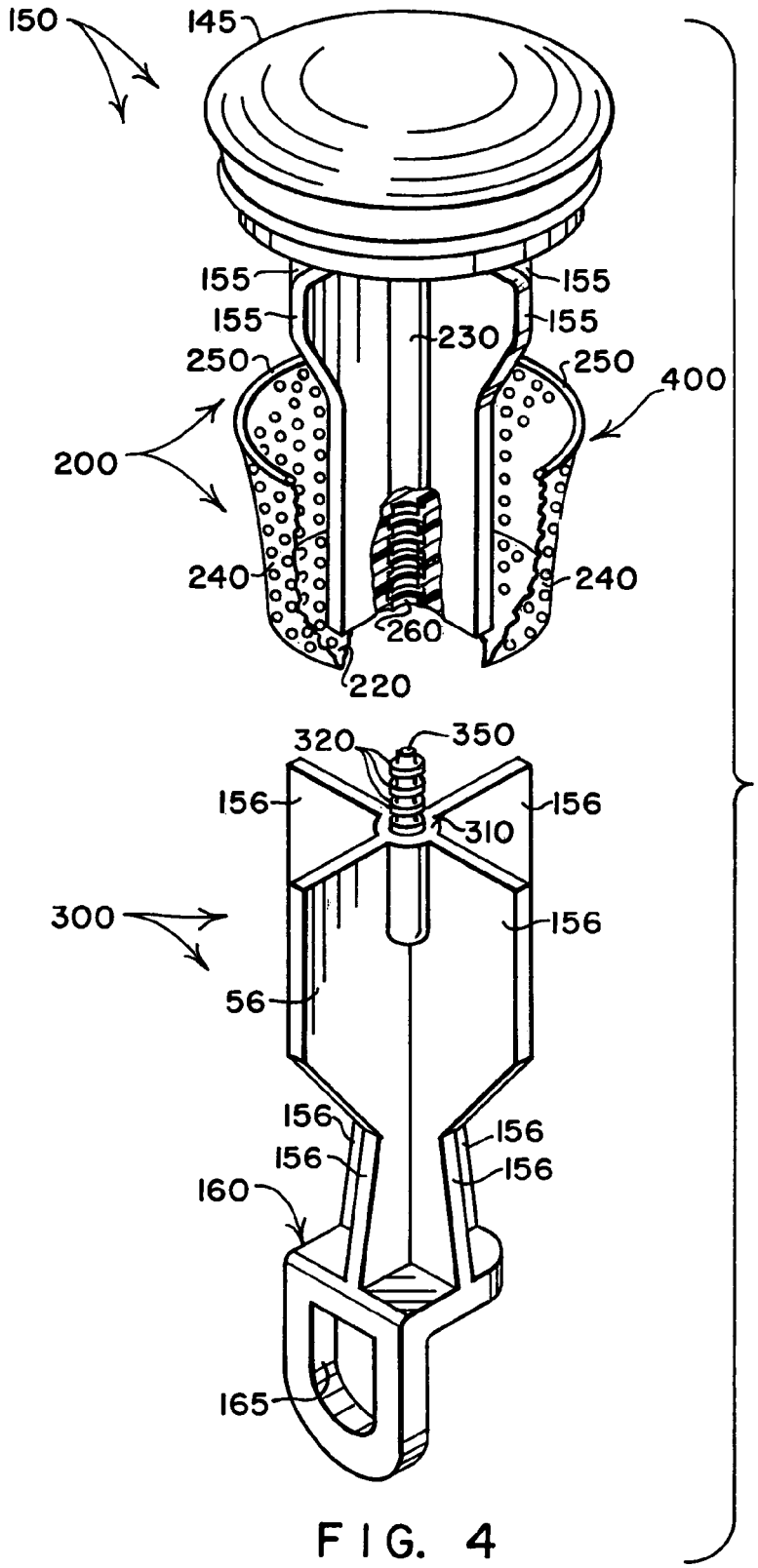
FIG. 4 is an exploded view showing, in disassembly, components of the improved stopper or plug illustrated in FIG. 3.
Figure 6:
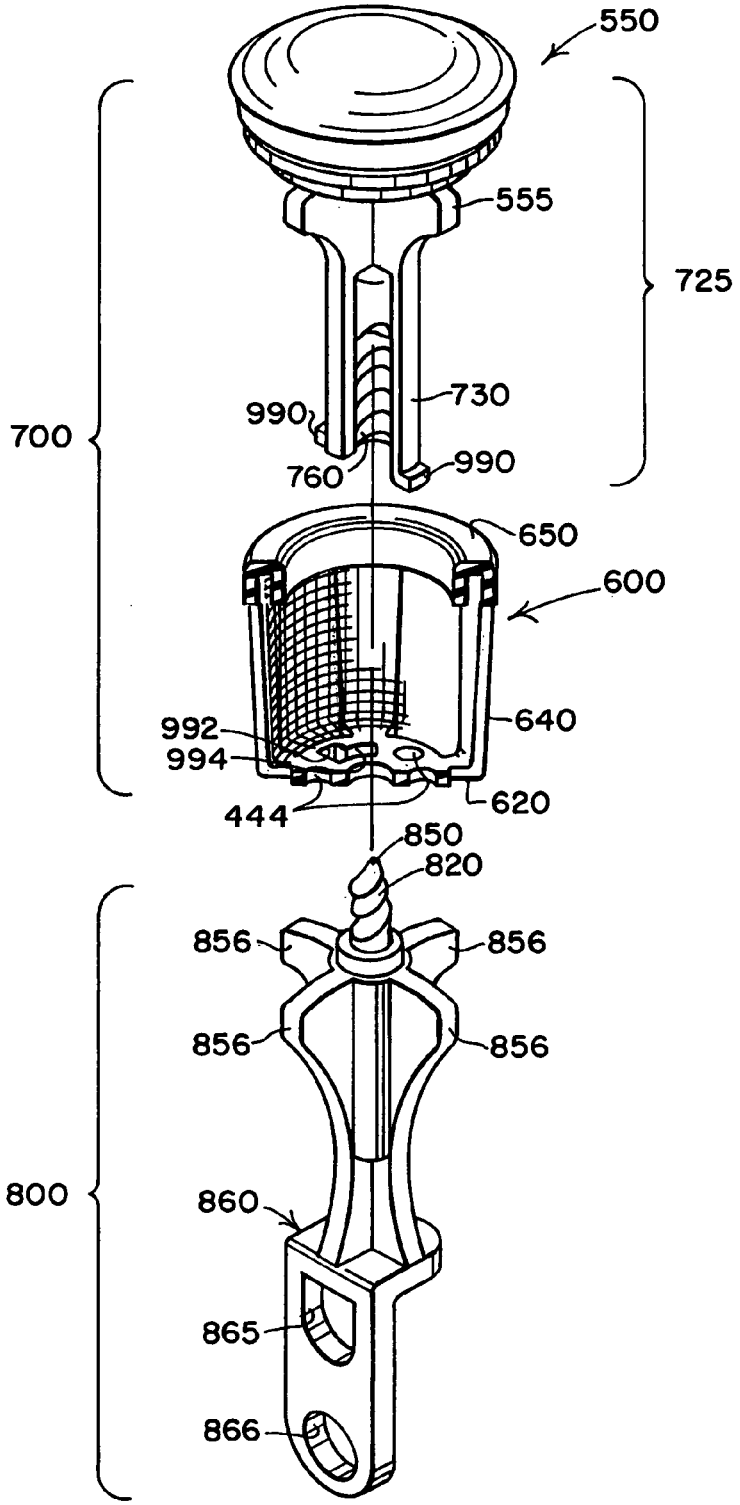
FIG. 6 is an exploded view showing, in disassembly, components of another improved embodiment of an improved pop-up drain valve stopper or plug having a strainer cup that is a removable component of an upper portion or half thereof.
Figure 7:
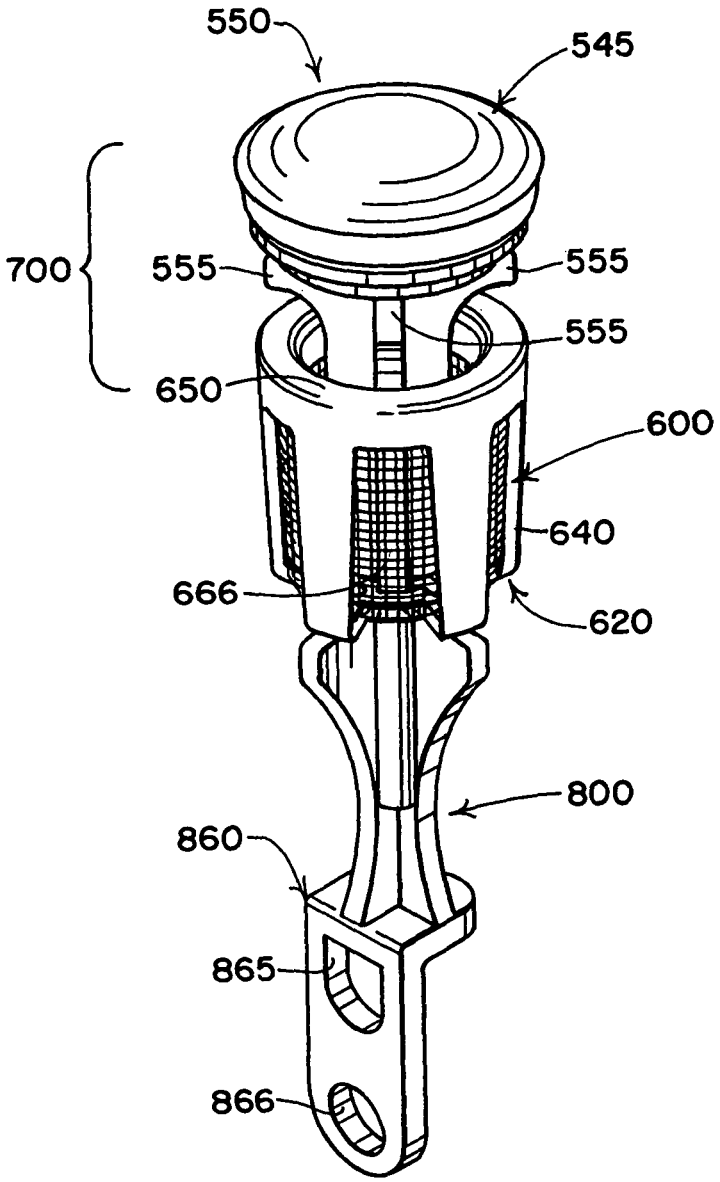
FIG. 7 is a perspective view showing the components of the drain valve stopper or plug of FIG. 6 in an assembled configuration.

As has been explained, FIGS. 1 and 2 depict a conventional, prior art, elongate pop-up stopper or plug 50 that can be installed within a conventional, prior art, drain pipe 75 of a conventional, prior art, drain valve assembly 40, in the manner shown in FIG. 2. FIGS. 3 and 4 depict one embodiment of an improved elongate pop-up stopper or plug 150 that can serve as a direct replacement for the conventional, prior art, pop-up stopper or plug 50 to provide a set of improved features to a conventional, prior art, drain valve assembly such as is indicated by the numeral 40 in FIGS. 2 and 5. FIGS. 6 and 7 depict another embodiment of an improved elongate pop-up stopper or plug 550 that can serve as a direct replacement for the prior art stopper or plug 50.

The pop-up stopper or plug embodiment 150 of shown in FIGS. 3 and 4 has an upper or top portion 200 that is releasably connected to, and can be easily detached from, a lower or bottom portion 300 which is retained within an associated drain pipe (such as is indicated by the numeral 40 in FIGS. 2 and 5) when a strainer cup 400 that is an integral part of the upper or top portion 200 needs to be cleaned, or when the upper or top portion 200 needs to be replaced.

The pop-up stopper or plug embodiment 550 shown in FIGS. 6 and 7 has an upper or top portion 700 that is releasably connected to, and can be easily detached from, a lower or bottom portion 800 which is retained within an associated drain pipe (such as is indicated by the numeral 40 in FIGS. 2 and 5) when a strainer cup 600 that detachably coupled to another part 725 of the upper or top portion 700 which is reused when a replacement strainer cup 600 is attached thereto.

Figure 5:
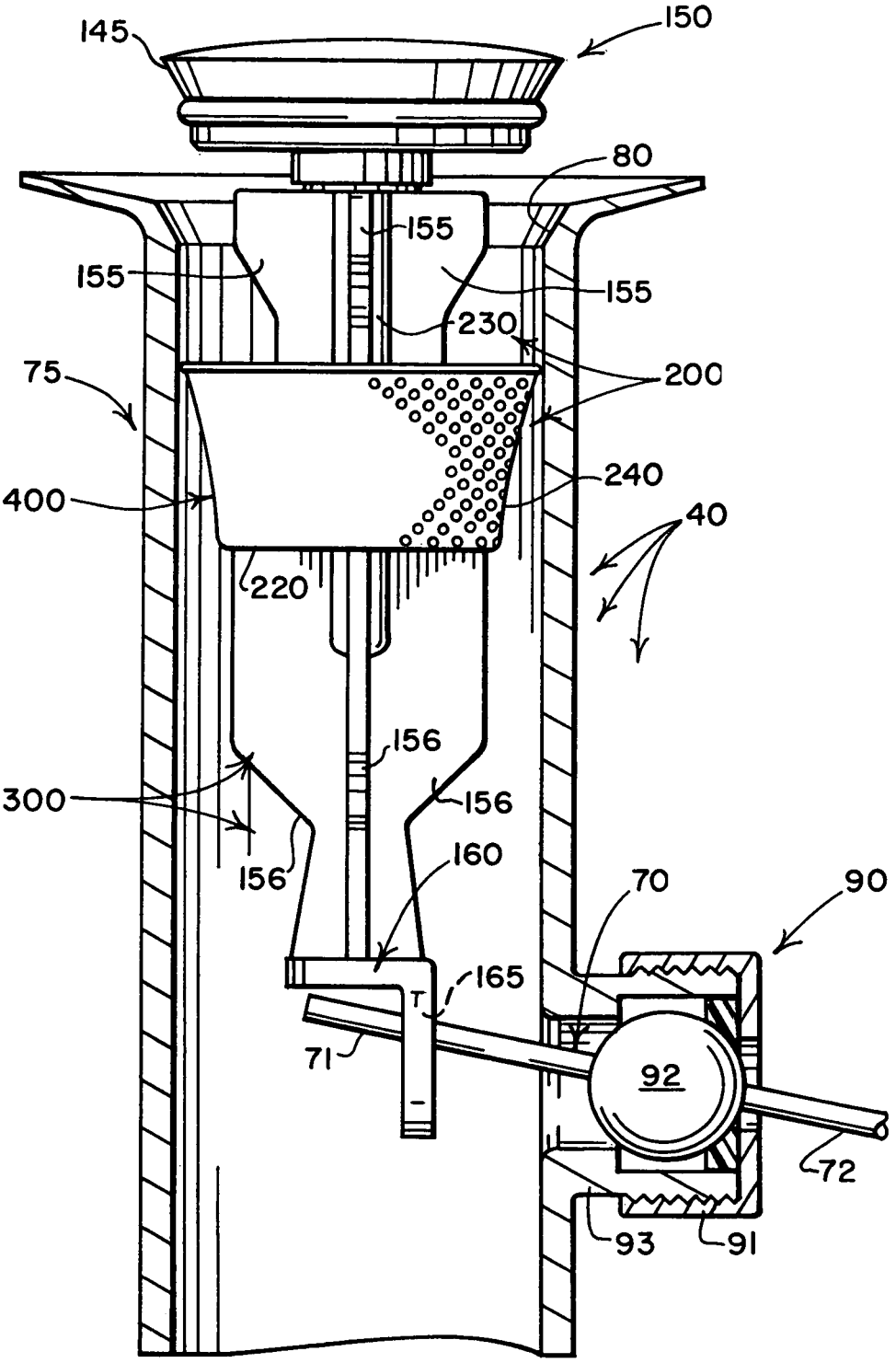
FIG. 5 is a front elevational view, partially in cross-section, showing the conventional drain valve assembly of FIG. 2, but with an improved stopper or plug of the type shown in FIGS. 3 and 4 installed therein and forming a component thereof.

If the integrally formed strainer cup 400 of the embodiment 150 shown in FIGS. 3 and 4 needs to be cleaned of collected hair and/or debris strained from drain liquid passing therethrough, the upper or top portion 200 is disconnected from the lower or bottom portion 300 (which is retained in the associated drain pipe such as is indicated by the numeral 75 in FIGS. 2 and 5) so the strainer cup 400 can be cleaned, or so the entire upper or top portion 200 can be replaced. In contradistinction, if the separately formed strainer cup 600 shown in FIGS. 6-8 needs to be cleaned of collected hair and/or debris strained from drain liquid passing therethrough, the upper or top portion 725 can be detached from the strainer cup 600 to enable the strainer cup 600 to be easily cleaned and reattached to the remainder 725 of the upper or top portion 700, or to enable the strainer cup 600 to be easily replaced by a new, clean strainer cup 600 so the upper or top portion 700 can be reassembled and reinserted into the associated drain pipe and reconnected to the lower or bottom portion 800.

In the embodiment 150 of FIGS. 3 and 4, the lower or bottom portion 300 is releasably connected to the upper or top portion 200 by an upstanding, centrally located stud 350 that has a set of threads 320 designed to be threaded into a downwardly opening passage 260 defined by a central stem part 230 of the upper or top portion 200. In the embodiment 550 of FIGS. 6 and 7, the lower or bottom portion 800 is releasably connected to the upper or top portion 700 by an upstanding, centrally located stud 850 of the lower or bottom portion 800 that has a set of threads 820 designed to be threaded into a downwardly opening passage 760 defined by a central stem part 730 of the upper or top portion member 725.

The upper or top portions 200, 700 have cap or top structures 145 or 545, respectively, at their upper end region that is preferably substantially identical to the cap or top structure 45 that is provided on the conventional stopper or plug 50. The lower end bottom portions 300, 800 are provided with formations 160, 860, respectively, that define operating openings 165, 865 (and/or 866), respectively, that function in the same manner as the operating opening 65 to receive an operating rod (such as is indicated in FIGS. 2 and 5 by the numeral 70).

The embodiments 150 and 550 are provided with various rib formations 155, 156, 555, and 856 respectively, to reinforce and strengthen in the manner of the ribs 55 of the prior art embodiment 50, as will be readily apparent to those who are skilled in the art.

Figure 8:
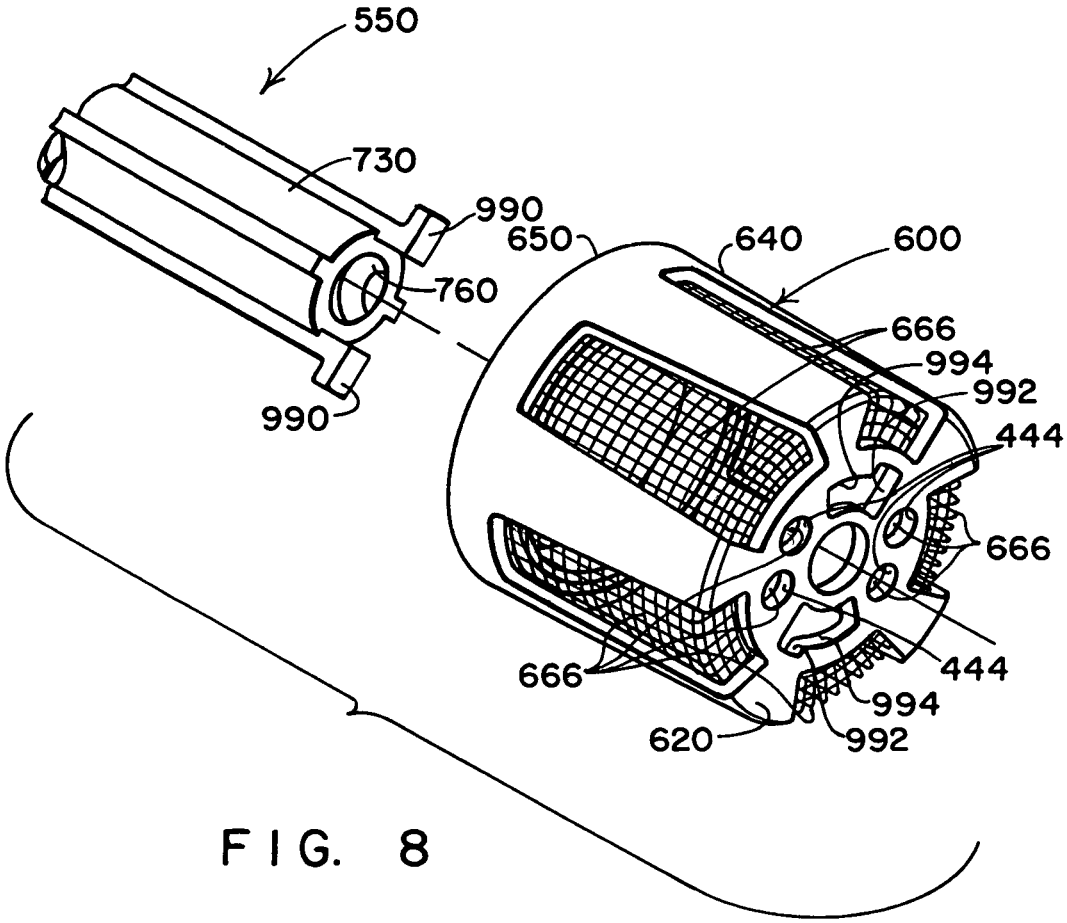
FIG. 8 is an exploded view showing, in disassembly, selected elements including a slightly modified strainer cup of the upper portion or half of a drain valve stopper or plug embodying features of the present invention, with a screen wire strainer extending interiorally of a plastic cage, and with the wire strainer extending across holes defined by a bottom wall of the plastic cage, but not across curved openings that are used to receive formations of a twist-type connection that releasably couples the strainer cup to another portion of the upper or top portion of the drain valve stopper or plug embodiment shown in FIGS. 6-7.

The strainer cups 400, 600 have tapered, upstanding side walls 240, 640 that may be formed entirely from one material (as shown in FIGS. 4 and 5), or by a combination of perforated parts or members (as shown in FIGS. 6-8) to provide strainer cups 400, 600 for drain liquid. The material or materials that are perforated to provide the strainer cups 400, 600 may include plastic and/or screen wire, and rim portions 250, 650 may be provided at or near the upper ends of the strainer cups 400, 600, to wipe gently along the interior of associated drain pipes 75 as the strainer cups 400, 600 are raised and/or lowered in the associated drain pipes 75.

Bottom walls 220, 620 of the strainer cups 400, 600, respectively, may provide holes defined by plastic or the like—such as are indicated by the numerals 444 in FIGS. 6 and 8, which may be covered by screen wire material 666 or the like, as shown in FIG. 8—as may be deemed appropriate.

The thread sets 320, 820 (shown in FIGS. 4 and 6, respectively, may require several relative turns, or only a few relatively turns, of the upper and lower portions 200, 300 or 700, 800, respectively, to securely but releasably couple the upper and lower portions 200, 300 or 700, 800.

Although it is preferred that a gently operable threaded connection is provided between the upper or top, and lower or bottom portions of halves 200, 300 and 700, 800, respectively, other types of connections can, of course, be substituted for the components described above that establish a connection (other than a threaded connection) between the upper or top, and lower or bottom portions or halves 200, 300 and 700, 800, respectively.

Although it is preferred that a stopper or plug 150 or 550 embodying features of the present invention include a strainer cup 400 or 600 that is configured as is illustrated in FIG. 3-5 or 6-7, respectively, strainer cups of other configurations can of course be substituted for the strainer cup 400 or 600.

Although it is preferred that a stopper or plug 150 or 550 embodying features of the present invention is formed primarily from plastics material, other materials including stiff cloth, stiff paper, stiff thin metal, and the like may be substituted for part or all of the material that forms the stopper or plug 150 or 550. In FIG. 8, for example, a thin wire mesh 666 is shown extending not only up the upstanding sidewall 640 of the depicted strainer cup 600, but also extending across perforated portions of the bottom wall 620 of the depicted strainer cup 600.

In FIGS. 6 and 8 it can be seen that oppositely extending formations 990 which extend downwardly and outwardly from the upper portion and can extend into enlarged end regions 992 of curved openings 994 formed in a bottom wall 620 of the strainer cup 600 to establish a twist connection for releasably connecting the depicted strainer cup 600 to another part 730 of the upper or top portion 725 of a stopper or plug 550 of the type shown in FIGS. 6 and 7.

Although the invention has been described in a preferred form with particularity, it is understood that the present disclosure of a preferred and an alternate form have been made only by way of example, and that numerous changes in the details of construction and the combination and arrangement of parts may be resorted to without departing from the spirit and scope of the invention.

What is claimed is:

1. A pop-up drain valve stopper comprising an elongate member sized to be movable vertically within a drain pipe of a sink; with the stopper having an upper portion that carries a cap which can be lowered into sealing engagement with an opening of the drain pipe, and having a lower portion that defines an operating opening through which an operating lever is able to extend to raise and lower the stopper to elevate and lower the cap relative to the opening of the drain pipe; with a releasable and reconnectable coupling being provided between the upper and lower portions; with the upper portion releasably carrying a strainer cup when the upper and lower portions are releasably connected, the strainer cup configured to enable the upper and lower portions to be releasably connected through a floor of the strainer cup, and the strainer cup configured to catch hair and other foreign matter that would otherwise pass by the stopper and into the drain pipe; with a pair of oppositely-extending formations that extend downwardly and outwardly from the upper portion toward the floor of the strainer cup; and with a pair of curved openings that each include an enlarged end region defined through the floor of the strainer cup, each one of the pair of curved openings to receive a corresponding one of the pair of oppositely-extending formations through the enlarged end region, wherein the pair of oppositely-extending formations can be caused to engage and disengage the pair of curved openings by relatively turning the strainer cup and the upper portion in opposite directions of clockwise and counterclockwise rotation to releasably retain the strainer cup on the upper portion during withdrawal of the upper portion from the drain pipe.

2. The pop-up drain valve stopper of claim 1 wherein the coupling is defined by an externally threaded stud carried by one of the upper and lower portions that can extend through a hole defined through the floor of the strainer cup and be threaded into an internally threaded passage defined by the other of the upper and lower portions to releasably connect the upper and lower portions through the floor of the strainer cup with the floor of the strainer cup interposed between the upper and lower portions.

3. The pop-up drain valve stopper of claim 1 wherein the strainer cup is perforated and positioned by the drain valve stopper to cause drain liquid to be strained by the strainer cup.

4. The pop-up drain valve stopper of claim 3 wherein the floor of the strainer cup is perforated and the strainer cup has an upstanding side wall.

5. The pop-up drain valve stopper of claim 4 wherein the strainer cup has a rim that wipes along an interior of the drain pipe when the stopper is raised and lowered within the drain pipe.

6. The pop-up drain valve stopper of claim 5 wherein the upstanding side wall is perforated and is tapered to diminish in radius as the side wall descends from the rim.

7. A pop-up drain valve stopper comprising an elongate member sized to be movable vertically within a drain pipe of a sink; with the stopper having an upper portion that is detachable from a lower portion of the stopper; with the upper portion removably carrying, when the upper and lower portions are releasably attached, a replaceable strainer cup through which drain liquid passing into the drain pipe from the sink can be strained to capture hair and foreign matter in the drain liquid, the strainer cup configured to enable the upper and lower portions to be releasably attached through a bottom wall of the strainer cup; with a pair of oppositely-extending formations of the upper portion that extend downwardly and outwardly from the upper portion toward the bottom wall of the strainer cup; with a pair of curved openings defined in the bottom wall of the strainer cup that each include an enlarged end region to receive a corresponding one of the oppositely-extending formations, wherein the pair of oppositely-extending formations can be caused to engage and disengage the pair of curved opening by relatively turning the strainer cup and the upper portion in opposite directions of clockwise and counterclockwise rotation to releasably retain the strainer cup on the upper portion during withdrawal of the upper portion from the drain pipe; with the lower portion defining an operating opening through which an operating lever is able to extend to raise and lower the stopper so a top formation of the upper portion can selectively open and close an opening defined by the drain pipe; and with the lower portion being configured to be retained within the drain pipe when the upper portion is detached from the lower portion.

8. The pop-up drain valve stopper of claim 7 wherein an externally threaded stud is carried by a selected one of the upper and lower portions, with the stud being extendable through a hole defined in the bottom wall of the strainer cup and threadable into an internally threaded passage defined by the other of the upper and lower portions to releasably connect the upper and lower portions through the bottom wall of the strainer cup with the bottom wall of the strainer cup interposed between the upper and lower portions.

9. The pop-up drain valve stopper of claim 7 wherein the strainer cup is perforated and positioned by the drain valve stopper to cause substantially all drain liquid passing into the drain pipe to be strained by the strainer cup.

10. The pop-up drain valve stopper of claim 7 wherein the strainer cup has an upstanding side wall of tapered, truncated conical form that diminishes in diameter as it descends into the drain pipe.

11. The pop-up drain valve stopper of claim 10 wherein the upstanding side wall has a rim near a top part of the upstanding sidewall that wipes along an interior of the drain pipe when the stopper is raised and lowered within the drain pipe.

12. The pop-up drain valve stopper of claim 7 wherein the strainer cup has an upstanding side wall the rim perforated and is tapered to diminish in radius as the side wall descends from a rim formed near an upper part of the side wall that is sized to wipe along an interior part of the drain pipe as the stopper is raised and lowered within the drain pipe.

13. An elongate, pop-up drain valve stopper having disconnectable upper and lower portions; with the upper portion releasably carrying a replaceable strainer cup when the upper and lower portions are releasably connected, wherein the strainer cup can be removed from the upper portion when the upper portion is disconnected from the lower portion; with the lower portion configured to be retained within a drain pipe when the upper portion is disconnected from the lower portion; with the lower portion carrying an externally threaded stud that can extend through a hole defined by a floor of the strainer cup and be threaded into an internally threaded passage defined by the upper portion to enable connection of the upper portion to the lower portion with the floor of the strainer cup interposed between the upper and lower portions, and to enable disconnection of the upper portion from the lower portion and withdrawal of the upper portion from the drain pipe; with a pair of oppositely-extending formations of the upper portion that extend downwardly from the upper portion toward the floor of the strainer cup; and with a pair of curved openings defined by the floor of the strainer cup at locations surrounding the hole, and that each include an enlarged end region to receive a corresponding one of the pair of oppositely-extending formations to releasably retain the strainer cup on the upper portion, wherein the pair of oppositely-extending formations can be caused to engage and disengage the pair of curved openings by relatively turning the strainer cup and the upper portion in opposite directions of clockwise and counterclockwise rotation to releasably retain the strainer cup on the upper portion as the upper portion is disconnected from the lower portion and is withdrawn from the drain pipe.

14. The elongate, pop-up drain valve stopper of claim 13 wherein the strainer cup comprises a wire mesh that extends across a perforated portion of the strainer cup to allow drain liquid to pass through the strainer cup and into the drain pipe while catching hair and foreign matter in the drain liquid.

15. A pop-up drain valve stopper having a lower portion that is retained in a drain pipe connected to a sink bowl to receive drain liquid from the sink bowl, and an upper portion releasably connected to the lower portion by a threaded connection that enables the upper portion to be disconnected from the lower portion to enable the upper portion to be withdrawn from the drain pipe; with a strainer cup releasably connected to the upper portion when the upper and lower portions are releasably connected, and removable from the upper portion for cleaning after the upper portion is disconnected from the lower portion and withdrawn from the drain pipe, wherein a hole is defined in a perforated floor of the strainer cup to enable the upper portion to be releasably connected to the lower portion by the threaded connection through the perforated floor; with a pair of oppositely-extending formations that extend downwardly and outwardly from the upper portion toward the perforated floor of the strainer cup; and with a pair of curved openings defined in the perforated floor at locations surrounding the hole, and that each include an enlarged end region to receive a corresponding one of the oppositely-extending formations, wherein the pair of oppositely-extending formations can be caused to engage and disengage the pair of curved openings by relatively turning the strainer cup and the upper portion in opposite directions of clockwise and counterclockwise rotation to releasably retain the strainer cup on the upper portion as the upper portion is disconnected from the lower portion and as the upper portion is withdrawn from the drain pipe.

16. The pop-up drain valve stopper of claim 15 wherein the strainer cup comprises a wire mesh that extends across the perforated floor of the strainer cup to allow drain liquid to pass through the strainer cup and into the drain pipe while catching hair and foreign matter in the drain liquid.

* * * * *